US009093807B2

(12) United States Patent
O'Connor et al.

(10) Patent No.: US 9,093,807 B2
(45) Date of Patent: Jul. 28, 2015

(54) PLUG RELIEF FOR ELECTRICAL JACK

(71) Applicant: Hubbell Incorporated, Shelton, CT (US)

(72) Inventors: Douglas P. O'Connor, Richmond, RI (US); Shadi Abu Ghazaleh, Oakdale, CT (US)

(73) Assignee: HUBBELL INCORPORATED, Shelton, CT (US)

( * ) Notice: Subject to any disclaimer, the term of this patent is extended or adjusted under 35 U.S.C. 154(b) by 15 days.

(21) Appl. No.: 13/826,055

(22) Filed: Mar. 14, 2013

(65) Prior Publication Data

US 2014/0273655 A1 Sep. 18, 2014

(51) Int. Cl.

| | |
|---|---|
| ***H01R 13/629*** | (2006.01) |
| ***H01R 24/64*** | (2011.01) |
| *H01R 13/24* | (2006.01) |
| *H01R 27/00* | (2006.01) |

(52) U.S. Cl.

CPC ..... *H01R 24/64* (2013.01); *H01R 13/24* (2013.01); *H01R 13/629* (2013.01); *H01R 27/00* (2013.01); *H01R 2201/04* (2013.01)

(58) Field of Classification Search

USPC ..... 439/676, 677, 680, 660

See application file for complete search history.

(56) References Cited

U.S. PATENT DOCUMENTS

| | | | | |
|---|---|---|---|---|
| 5,387,135 | A * | 2/1995 | Shen et al. | 439/676 |
| 6,186,835 | B1 * | 2/2001 | Cheshire | 439/676 |
| 6,283,796 | B1 | 9/2001 | Yeh | |
| 6,296,528 | B1 * | 10/2001 | Roberts et al. | 439/676 |
| 6,319,070 | B1 | 11/2001 | Tan | |
| 6,375,516 | B1 | 4/2002 | Trinh | |
| 6,458,001 | B1 | 10/2002 | Chen et al. | |
| 6,857,910 | B2 | 2/2005 | Lin | |
| 6,935,900 | B2 | 8/2005 | Wan et al. | |
| 7,114,995 | B1 * | 10/2006 | Ohshima | 439/680 |
| 7,125,288 | B2 * | 10/2006 | Schilling | 439/676 |
| 7,311,562 | B2 * | 12/2007 | Leong et al. | 439/767 |
| 7,670,194 | B1 * | 3/2010 | Fitzpatrick | 439/677 |
| 7,708,602 | B2 * | 5/2010 | Rascon et al. | 439/676 |
| 7,985,101 | B2 * | 7/2011 | Fitzpatrick | 439/676 |
| 8,287,297 | B2 * | 10/2012 | Schmidt et al. | 439/345 |
| 2003/0129880 | A1 | 7/2003 | Arnett et al. | |
| 2004/0235358 | A1 | 11/2004 | Wan et al. | |
| 2008/0194147 | A1 | 8/2008 | Wu et al. | |
| 2008/0220657 | A1 | 9/2008 | Rascon et al. | |

* cited by examiner

*Primary Examiner* — Alexander Gilman

(74) *Attorney, Agent, or Firm* — Roylance, Abrams, Berdo & Goodman, L.L.P.

(57) ABSTRACT

An electrical jack includes a housing having an opening in a front face thereof. A cavity in the housing receives a plug inserted through the opening. A plurality of contact pins are disposed in the housing. A relief pocket is disposed rearwardly of the front face. First and second guide rails are disposed in the housing to guide a non-complementary plug into the relief pocket to substantially prevent damage to the plurality of contact pins.

20 Claims, 13 Drawing Sheets

FIG. 19
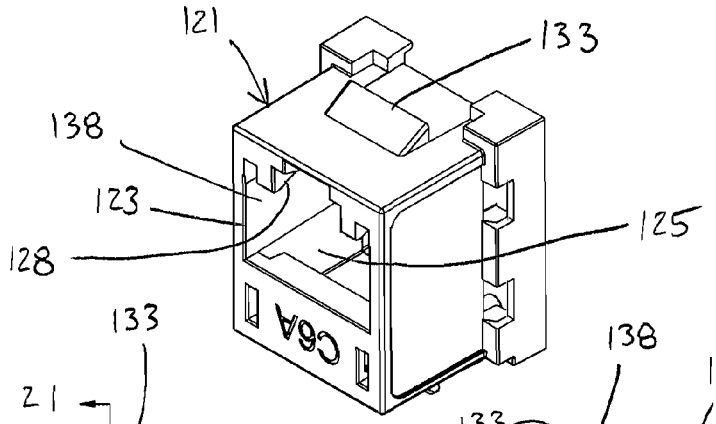
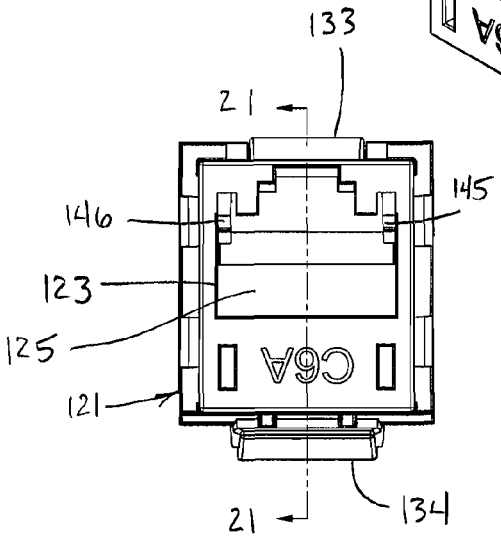
FIG. 20
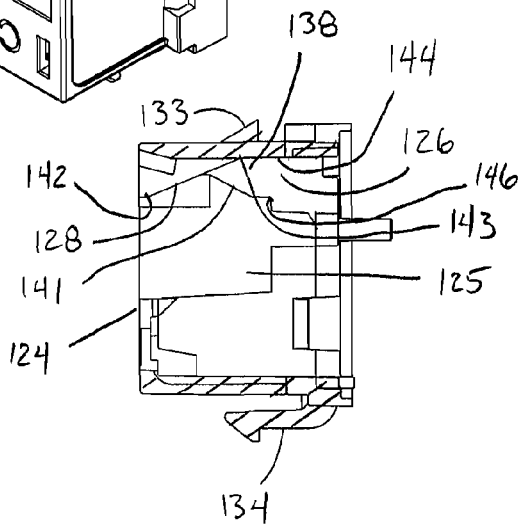
FIG. 21

FIG. 22
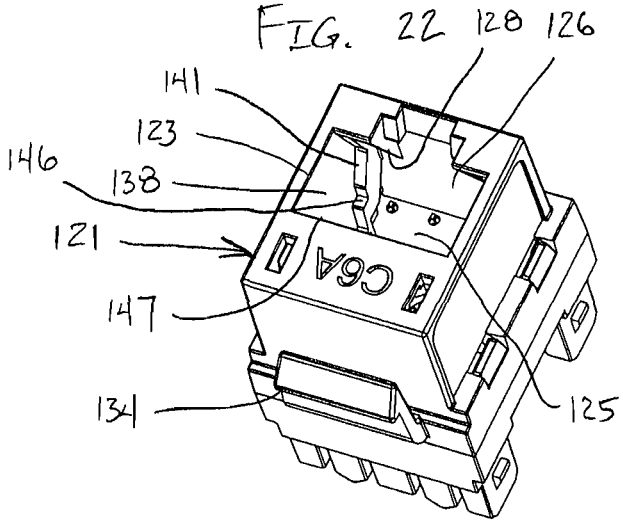
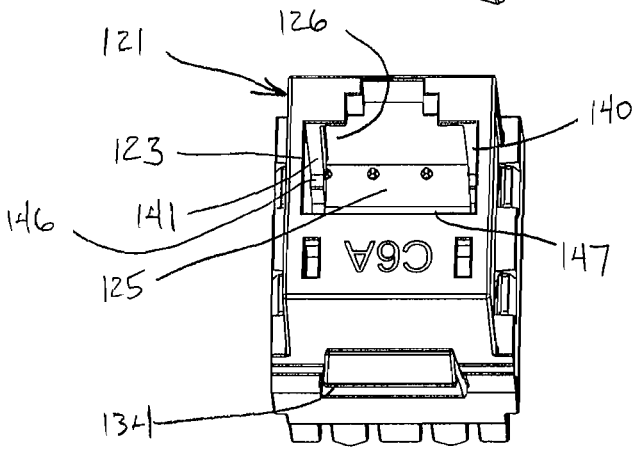
FIG. 23

FIG. 27
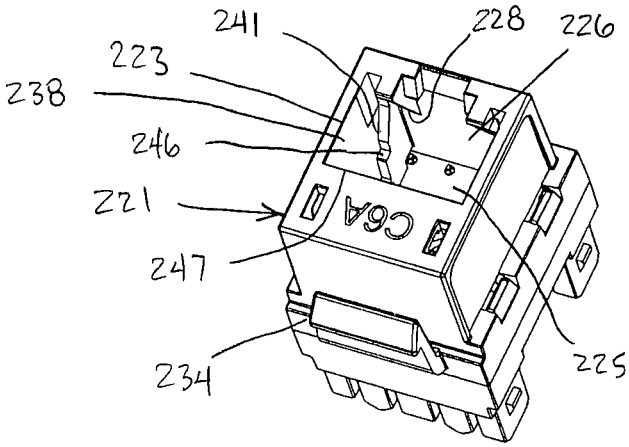
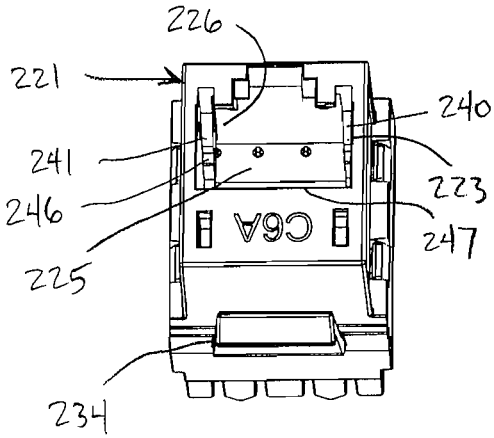
FIG. 28

PLUG RELIEF FOR ELECTRICAL JACK

FIELD OF THE INVENTION

The present invention relates to a relief pocket for an electrical receptacle. More particularly, the present invention relates to a relief pocket in an electrical jack to prevent damage to contact pins therein upon insertion of a non-complementary electrical plug. Still more particularly, the present invention relates to an RJ-45 jack having a relief pocket that allows insertion of a non-complementary RJ-11 jack and substantially prevents damage to contact pins of the RJ-45 jack from the insertion of the non-complementary RJ-11 jack.

BACKGROUND OF THE INVENTION

Telecommunications and data equipment are typically connected to a service by an electrical connector. Common connectors for such uses are RJ-11 and RJ-45 plugs. Conventional RJ-11 and RJ-45 plugs are shown in FIGS. 1-4.

The RJ-11 plug 1 shown in FIGS. 2 and 3 has six contacts 2 disposed in six slots 3 in the plug housing 4. The RJ-11 plug is typically used for connecting communications devices, such as between a telephone and a telephone jack in the wall.

The RJ-45 plug 5 shown in FIGS. 1 and 4 has eight contacts 6 disposed in eight slots 7 in the plug housing 8. The RJ-45 plug is typically used for Ethernet connections for local area networks (LANs), such as between a computer and a router.

As shown in FIGS. 1 and 2, the RJ-11 plug body 4 has a first width W1 that is less than a second width W2 of the RJ-45 plug body 8. Telephone and computer devices are often found in close proximity to one another. Because the RJ-11 and RJ-45 plugs have similar appearances and sizes, the RJ-11 plug can easily be mistaken for the RJ-45 plug. When the RJ-11 plug 1 is accidentally inserted in an RJ-45 jack, the portions of the plug housing immediately adjacent the first and last plug contacts 2 engage the first and last contact pins of the RJ-45 jack and over-deflect those contact pins. When the mistake is realized and the RJ-11 plug is withdrawn, the first and last contact pins of the RJ-45 jack may have been permanently damaged by the improper insertion of the RJ-11 plug into the RJ-45 jack.

U.S. Pat. No. 7,311,562 to Leong et al. discloses an RJ-45 jack having a groove 32 extending rearwardly from a front face, as shown in FIGS. 5A and 5B, to allow an inadvertently inserted RJ-11 plug to rise upward and away from the outer jack fingers 14. As shown in FIG. 5B, an upper surface of the inadvertently RJ-11 plug is substantially coplanar with an upper surface of the RJ-45 jack. Accordingly, the RJ-11 plug can still engage and damage the jack fingers 14.

Accordingly, a need exists for an improved plug receptacle having a relief pocket to accept insertion of a non-complementary plug and substantially prevent damage to contact pins of the receptacle by the insertion of the improper plug.

SUMMARY OF THE INVENTION

Accordingly, it is a primary objective of the present invention to provide an improved relief pocket for an electrical jack.

A further objective of the present invention is to provide an electrical jack that substantially prevents damage to contact pins therein upon insertion of a non-complementary electrical plug.

Another objective of the present invention is to provide an electrical jack having a ramped surface therein to guide an improper electrical plug into a relief pocket.

Another objective of the present invention is to provide an RJ-45 jack in which damage to contact pins therein is substantially prevented upon insertion of a non-complementary RJ-11 plug.

The foregoing objectives are basically attained by an electrical jack including a housing having an opening in a front face thereof. A cavity in the housing receives a plug inserted in a longitudinal direction through the opening. A plurality of contact pins are disposed in the housing. A relief pocket is disposed rearwardly of the front face. First and second guide rails are disposed in the housing to guide an inserted non-complementary plug obliquely away from the longitudinal direction and into the relief pocket to substantially prevent damage to the plurality of contact pins.

The foregoing objectives are also basically attained by an electrical jack including a housing having an opening in a front face thereof. A cavity in the housing receives a plug inserted in a longitudinal direction through the opening. A plurality of contact pins are disposed in the housing. A relief pocket in the cavity is formed opposite of the plurality of contact pins. The opening and at least one sloped surface extending into the relief pocket are configured to guide an inserted non-complementary plug obliquely away from the longitudinal direction and into the relief pocket to substantially prevent damage to the plurality of contact pins.

Other objects, advantages and salient features of the invention will become apparent from the following detailed description, which, taken in conjunction with the annexed drawings, disclose preferred embodiments of the invention.

As used in this application, the terms "front," "rear," "upper," "lower," "upwardly," "downwardly," and other orientational descriptors are intended to facilitate the description of the electrical plug connector and the electrical wiring device, and are not intended to limit the structure of the electrical plug connector and the electrical wiring device to any particular position or orientation.

BRIEF DESCRIPTION OF THE DRAWINGS

The above benefits and other advantages of the various embodiments of the present invention will be more apparent from the following detailed description of an exemplary embodiment of the present invention and from the accompanying drawing figures, in which:

FIG. 19 is a side perspective view of the electrical jack of FIG. 17;

FIG. 20 is a front elevational view of the electrical jack of FIG. 17;

FIG. 21 is a side elevational view in cross-section of the electrical jack taken along line 21-21 of FIG. 20;

FIG. 22 is a perspective view of the electrical jack of FIG. 17;

FIG. 23 is a front perspective view of the electrical jack of FIG. 17;

FIG. 27 is a side perspective view of the electrical jack of FIG. 24;

FIG. 28 is a front perspective view of the electrical jack of FIG. 24;

Throughout the drawings, like reference numbers will be understood to refer to like parts, components and structures.

DETAILED DESCRIPTION OF EXEMPLARY EMBODIMENTS

Figure 1:
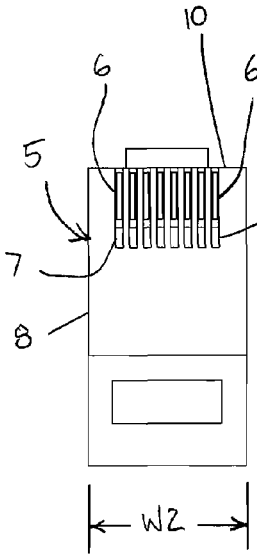
FIG. 1 is a top plan view of a conventional RJ-45 plug.
Figure 4:
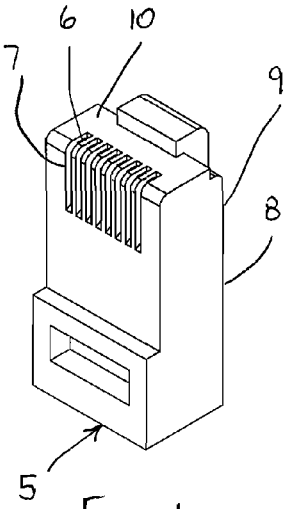
FIG. 4 is a perspective view of the RJ-45 plug of FIG. 1.

As shown in FIGS. 5, 7 and 9-16, an electrical jack 21 in accordance with a first exemplary embodiment of the present invention includes a housing 22 having an opening 23 in a front surface 24 thereof. The opening 23 allows a cavity 25 of the electrical jack 21 to receive an electrical plug, such as an RJ-45 plug (FIGS. 1 and 4). A relief pocket 26 is formed in the housing 22 and is connected to the cavity 25. Guide rails 27 and 28 are connected to the side walls 29 and 30 of the cavity 25 to guide a non-complementary plug to the relief pocket 26, thereby substantially preventing damage to the contact pins of the electrical jack 21.

The housing 22 of the electrical jack 21 has an upper outer surface 31 and an oppositely disposed lower outer surface 32. A fixed latch 33 is connected to the upper surface 31 and a resilient latch 34 is connected to the lower surface 32 to facilitate connecting the electrical jack 21 to a face plate (not shown). Side walls 35 and 36 extend between the upper and lower surfaces 31 and 32. The front surface 24 extends between front ends of the upper and lower surfaces 31 and 32 and the side walls 35 and 36. The opening 23 is disposed in the front surface 24 of the housing 22. The housing 22 is preferably unitarily formed as a single member.

Figure 16:
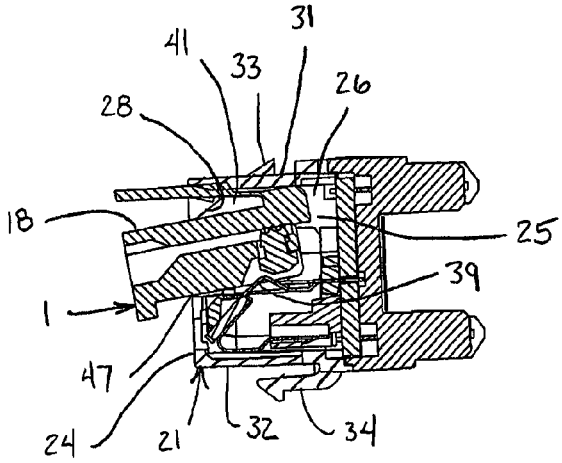
FIG. 16 is a side elevational view in cross-section of the jack and plug taken along line 16-16 of FIG. 14.

The cavity 25 is disposed in the housing 22. Access thereto is provided by the opening 23 in the front surface 24 of the housing 22. The cavity 25 has first and second inner side walls 37 and 38 extending rearwardly from the opening 23 in the front surface 24. As shown in FIG. 16, a plurality of contact pins 39 are disposed in the cavity 25 to engage contacts of a complementary electrical plug.

Figure 5:
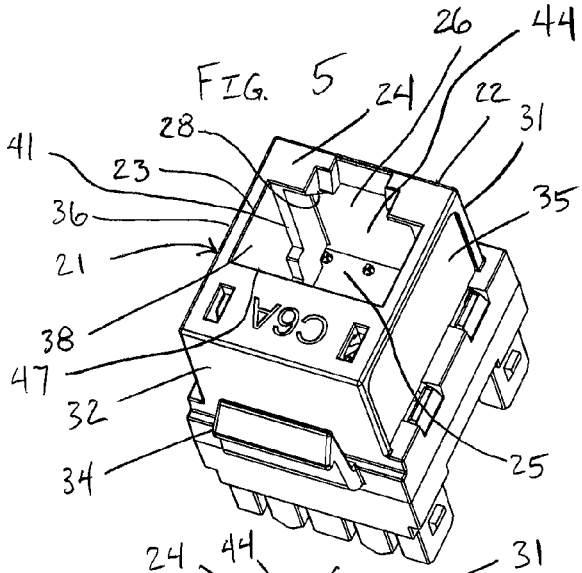
FIG. 5 is a perspective view of an electrical jack in accordance with a first exemplary embodiment of the present invention.
Figure 7:
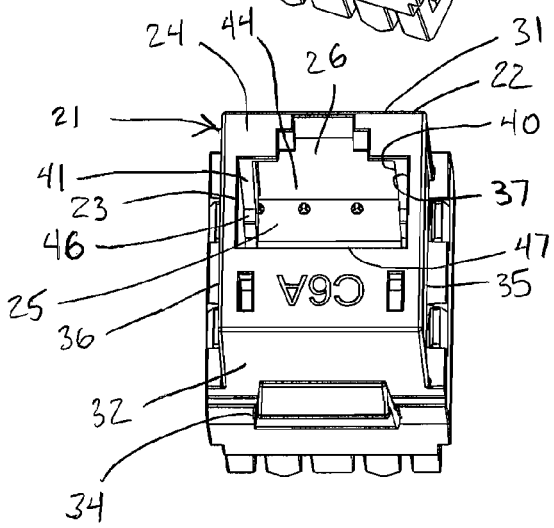
FIG. 7 is a front perspective view of the electrical jack of FIG. 5.
Figure 11:
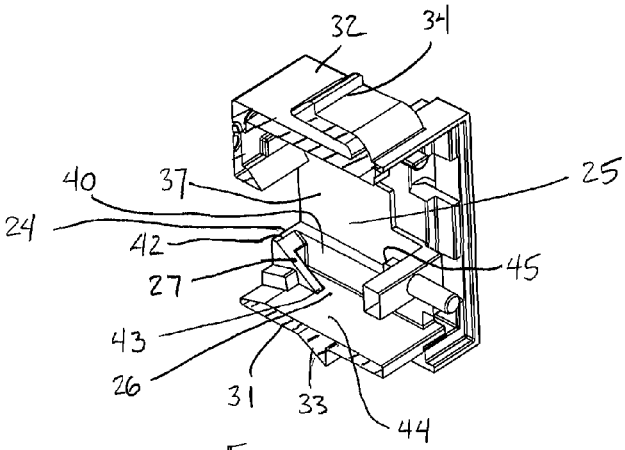
FIG. 11 is a partial perspective view of the electrical jack of FIG. 10.
Figure 12:
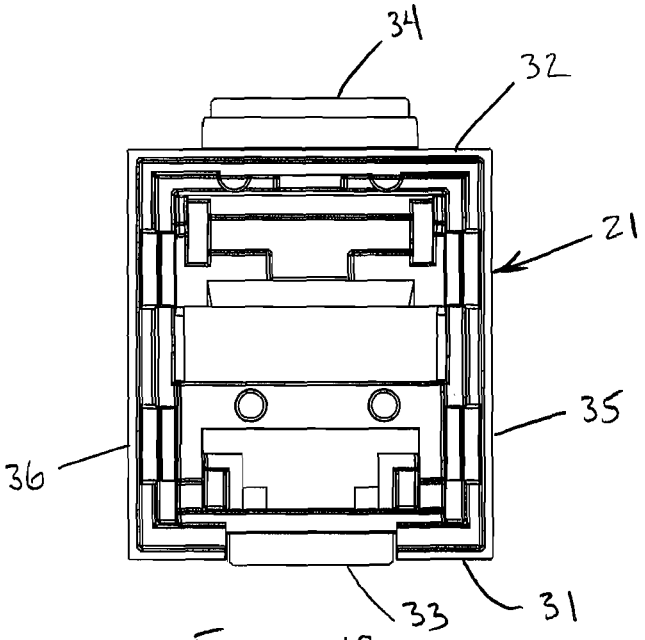
FIG. 12 is a rear elevational view of the electrical jack of FIG. 5.
Figure 13:
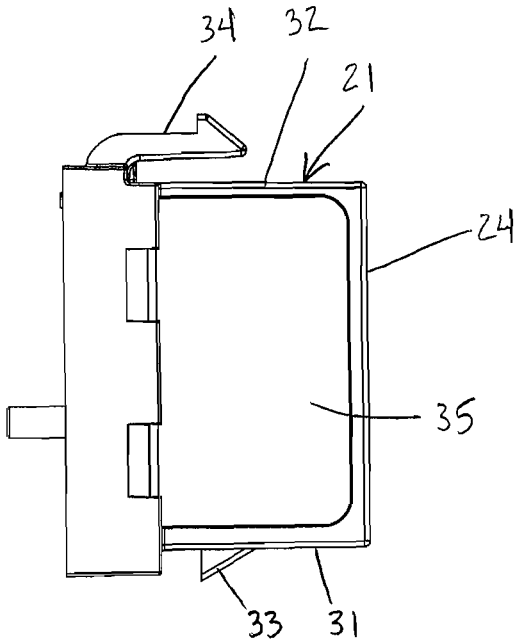
FIG. 13 is a side elevational view of the electrical jack of FIG. 5.

The guide rails, or inner guide rails, 27 and 28 are connected to and extend rearwardly along the inner side walls 37 and 38 of the cavity 25. As shown in FIGS. 5, 7 and 11, plug guides, or outer guide rails, 40 and 41 are disposed between the guide rails 27 and 28 and their respective inner side walls 37 and 38. The plug guides 40 and 41 are substantially identical. The guide rails 27 and 28 have first ends 42 spaced rearwardly of the front surface 24 and second ends 43 engaging an upper wall 44 of the cavity 25. The guide rails 27 and 28 are preferably substantially identical. As shown in FIG. 11, the guide rails 27 and 28 extend substantially continuously from the first end 42 to the second end 43 at a substantially constant angle and have a substantially flat surface. Plug stop members 45 and 46 are disposed at rearward ends of the plug guides 40 and 41 to limit the insertion depth of complementary plugs. The plug stop member 45 and 46 are adjacent the inner side walls 37 and 38. The plug guides 40 and 41 are substantially parallel to the cavity upper wall 44 between the front surface 24 of the housing 22 and the plug stop members 45 and 46.

Figure 6:
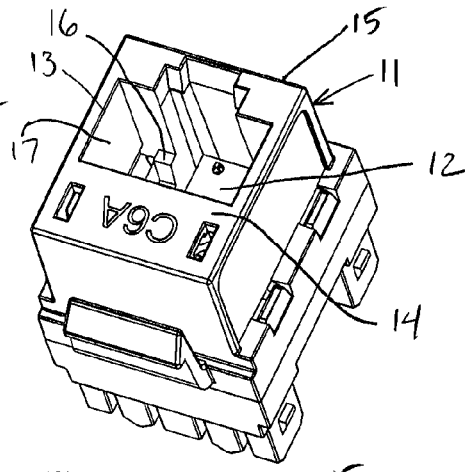
FIG. 6 (PRIOR ART)
FIG. 6 is a perspective view of a conventional electrical jack.
Figure 8:
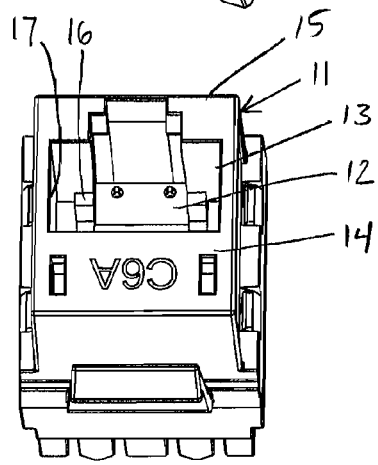
FIG. 8 (PRIOR ART)
FIG. 8 is a front perspective view of the conventional electrical jack of FIG. 6.
Figure 9:
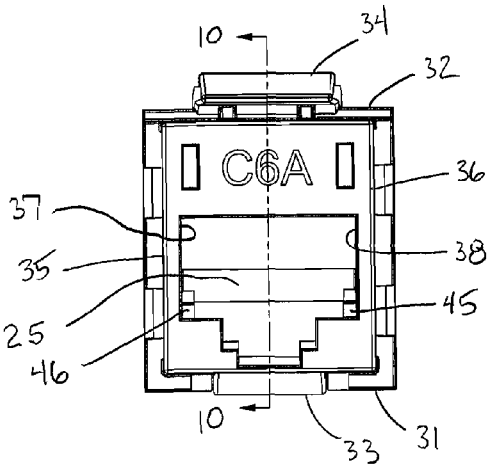
FIG. 9 is front elevational view of the electrical jack of FIG. 5.
Figure 10:
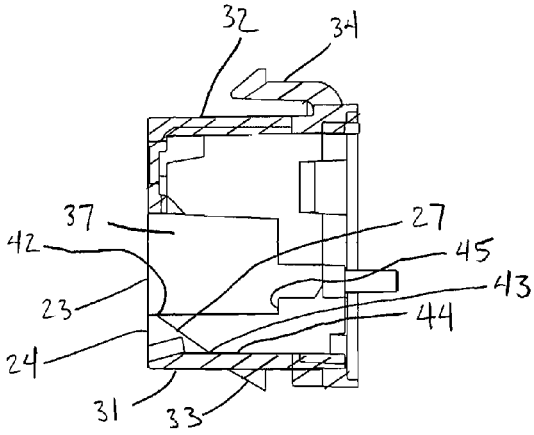
FIG. 10 is a side elevational view in cross-section taken along line 10-10 of FIG. 9.

For means of comparison, a conventional electrical jack 11 is shown in FIGS. 6 and 8. The conventional electrical jack 11 has a cavity 12 accessible through an opening 13 in a front surface 14 of a housing 15. A stop member 16 is spaced inwardly of a cavity side wall 17 to limit insertion depth of an electrical plug. The inward spacing of the plug stop member 16 prevents distinguishing between complementary and non-complementary plugs, such that a non-complementary plug engages and can damage contact pins of the plug. The plug stop members 45 and 46 of the electrical jack 21 of the first exemplary embodiment only engage a complementary plug 5, such that a non-complementary plug 1 is not prevented from being guided to the relief pocket 26.

When a complementary plug, such as an RJ-45 plug 5, is inserted in a complementary jack 21, such as an RJ-45 jack, the width W2 of the plug 5 is substantially equal to a width between the side walls 37 and 38 of the cavity 25. Accordingly, an upper surface 9 of the complementary plug 5 engages the plug guides 40 and 41, which guide the complementary plug straight along the longitudinal direction into the cavity 25. The front surface 10 of the complementary plug engages the stop members 45 and 46, thereby limiting insertion of the complementary plug into the cavity. In the inserted position, the plug contacts 6 engage the contact pins 39 of the electrical jack, thereby establishing electrical continuity therebetween. The complementary plug has an equivalent number of slots 7 as contact pins 39 in the cavity 25 of the electrical jack 21, such that the contact pins 39 are not damaged by insertion of the complementary plug.

Figure 2:
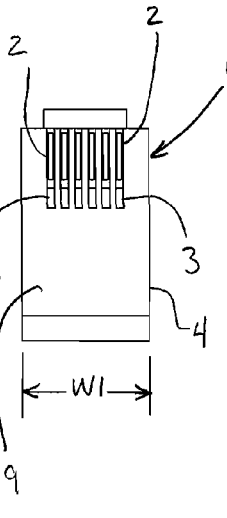
FIG. 2 is a top plan view of a conventional RJ-11 plug.
Figure 3:
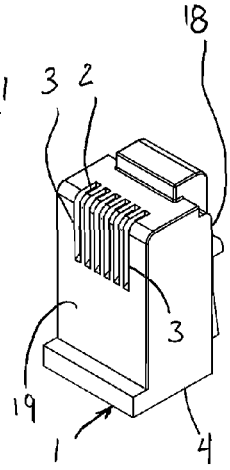
FIG. 3 is a perspective view of the RJ-11 plug of FIG. 2.
Figure 14:
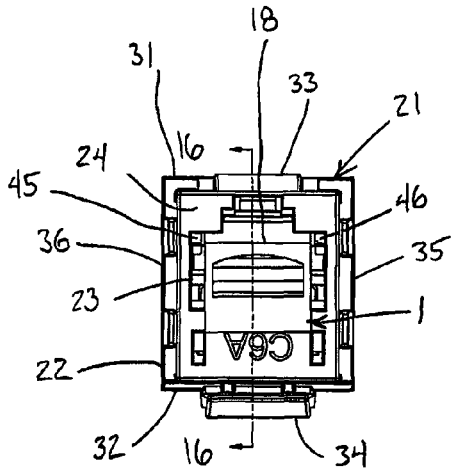
FIG. 14 is a front elevational view of the electrical jack of FIG. 5 in which an improper plug is inserted.
Figure 15:
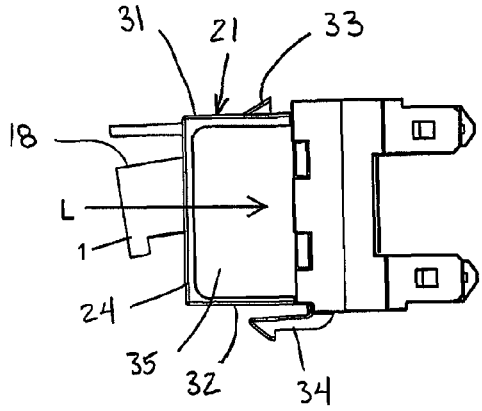
FIG. 15 is a side elevational view of the electrical jack and plug of FIG. 14.

When a non-complementary plug, such as an RJ-11 plug 1 (FIGS. 2 and 3), is inserted in a non-complementary jack 21, such as an RJ-45 jack, the width W1 of the non-complementary plug 1 is less than the width between the side walls 37 and 38 of the cavity 25. The width W1 of the non-complementary plug 1 is substantially equal to a width between the plug guides 40 and 41. Accordingly, an upper surface 18 of the non-complementary plug 1 engages the guide rails 27 and 28 disposed adjacent the plug guides 40 and 41 and is guided into the cavity 25. The non-complementary plug 1 has fewer slots 3 than contact pins 39 in the electrical jack 21; thus, a lower surface 19 of the non-complementary plug 1 is deflected upwardly by the contact pins 39 because there are no slots to receive the outermost contact pins 39. The guide rails 27 and 28 and the contact pins 39 direct the non-complementary plug 1 obliquely away from the longitudinal direction L and into the relief pocket 26, as shown in FIGS. 14-16. To further facilitate moving the non-complementary plug 1 into the relief pocket 26, an intersection surface 47 between the front surface 24 and the cavity 25 acts as a fulcrum to pivot the non-complementary plug 1, as shown in FIGS. 15 and 16.

An electrical jack 121 in accordance with a second exemplary embodiment is shown in FIGS. 17-23. The electrical jack 121 of the second exemplary embodiment is substantially identical to the electrical jack 21 of the first exemplary embodiment except for the configuration of the plug guides, or outer guide rails, 140 and 141. The same reference numerals are used to indicate similar features but in the 100 series, e.g., "1xx."

Figure 17:
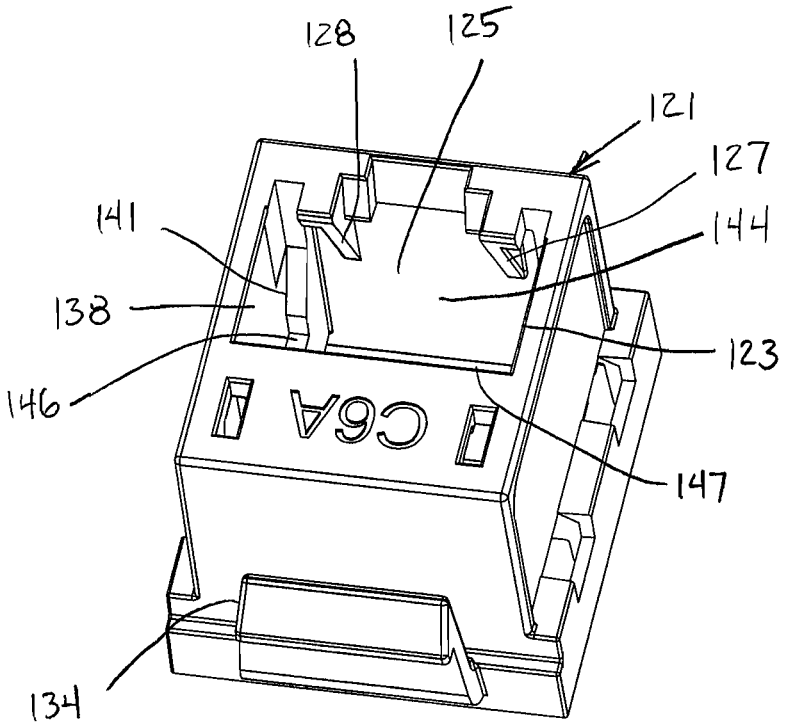
FIG. 17 is a perspective view of an electrical jack in accordance with a second exemplary embodiment of the present invention.
Figure 18:
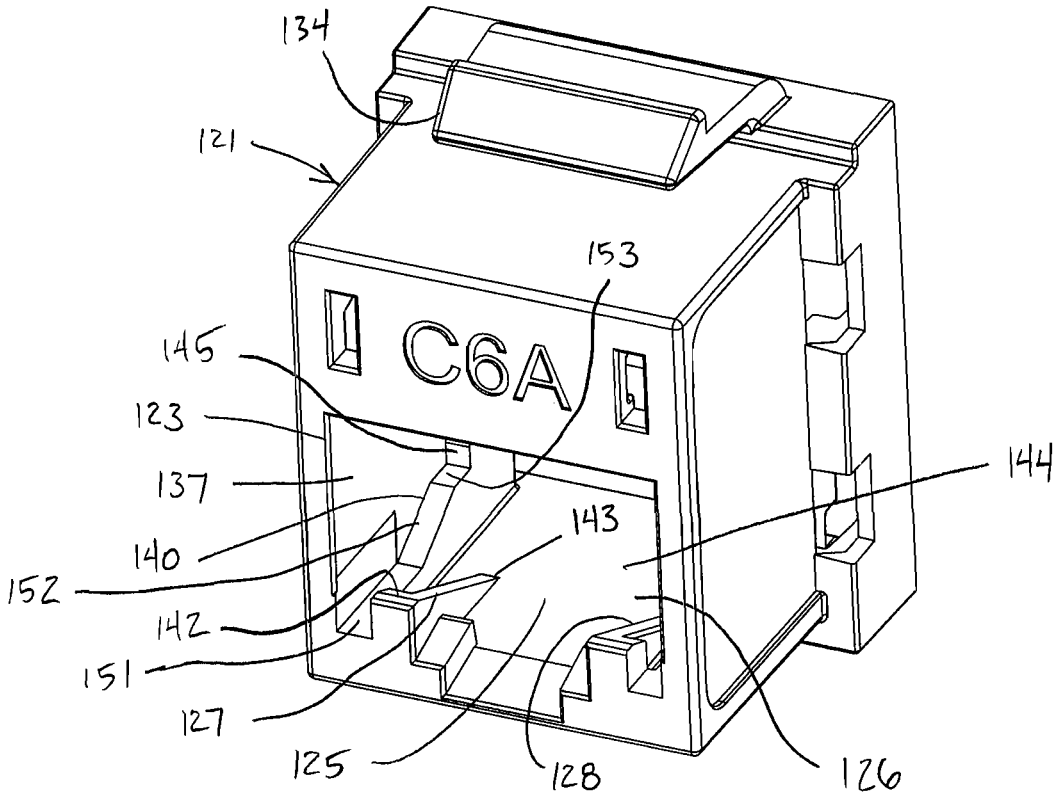
FIG. 18 is a front perspective view of the electrical jack of FIG. 17.

The guide rails, or inner guide rails, 127 and 128 are connected to and extend rearwardly along the inner side walls 137 and 138 of the cavity 125. As shown in FIGS. 17 and 18, plug guides, or outer guide rails, 140 and 141 are disposed between the guide rails 127 and 128 and their respective inner side walls 137 and 138. The guide rails 127 and 128 have first ends 142 spaced rearwardly of the front surface 124 and second ends 143 engaging an upper wall 144 of the cavity 125. The guide rails 127 and 128 are preferably substantially identical. As shown in FIG. 18, the guide rails 127 and 128 extend substantially continuously from the first end 142 to the second end 143 at a substantially constant angle and have a substantially flat surface. Plug stop members 145 and 146 are disposed at rearward ends of the plug guides 140 and 141 to limit the insertion depth of complementary plugs. The plug stop members 145 and 146 are adjacent the inner side walls 137 and 138.

The plug guides 140 and 141 have a first portion 151 extending rearwardly from the front surface of the housing 122. The first portion 151 is substantially parallel to the upper wall 144 of the cavity 125. A second portion 152 extends from an end of the first portion 151 rearwardly at an angle extending away from the upper wall 144 of the cavity 125. The second portion 152 extends in an opposite direction as the guide rails 127 and 128. A third portion 153 extends rearwardly from an end of the second portion 152 to the plug stop members 145 and 146. The third portion 153 is substantially parallel to the first portion 151.

When a complementary plug, such as an RJ-45 plug 5, is inserted in a complementary jack 121, such as an RJ-45 jack, the width W2 of the plug 5 is substantially equal to a width between the side walls 137 and 138 of the cavity 125. Accordingly, an upper surface 9 of the complementary plug 5 engages the plug guides 140 and 141, which guide the complementary plug into the cavity 125. The front surface 10 of the complementary plug 5 is initially guided by the inner guide rails 127 and 128 until the upper surface 10 engages the second portions 152 of the plug guides 140 and 141. The complementary plug 5 continues to follow the second and third portions 152 and 153 of the plug guides 140 and 141 until the complementary plug engages the stop members 145 and 146, thereby limiting insertion of the complementary plug into the cavity. The transition of the second portion 152 to the third portion 153 of the plug guides 140 and 141 properly aligns the complementary plug in a functional position in the cavity 125. In the inserted position, the plug contacts 6 engage the contact pins 39 (FIG. 16) of the electrical jack, thereby establishing electrical continuity therebetween. The complementary plug 5 has an equivalent number of slots 7 as contact pins 39 in the cavity 125 of the electrical jack 121, such that the contact pins 39 are not damaged by insertion of the complementary plug.

When a non-complementary plug, such as an RJ-11 plug 1 (FIGS. 2 and 3), is inserted in a non-complementary jack 121, such as an RJ-45 jack, the width W1 of the non-complementary plug 1 is less than the width between the side walls 137 and 138 of the cavity 125. The width W1 of the non-complementary plug 1 is substantially equal to a width between the plug guides 140 and 141. Accordingly, an upper surface 18 of the non-complementary plug 1 engages the guide rails 127 and 128 disposed adjacent the plug guides 140 and 141 and is guided into the cavity 125. As the width of the non-complementary plug 1 is less than that between the side walls 137 and 138, the non-complementary plug does not engage the plug guides 140 and 141 and continues at the pre-determined angle to the relief pocket 126. The non-complementary plug 1 has fewer slots 3 than contact pins 39 (FIG. 16) in the electrical jack 121. Thus, a lower surface 19 of the non-complementary plug 1 is deflected upwardly by the contact pins 39 because there are no slots to receive the outermost contact pins 39. The guide rails 127 and 128 and the contact pins 39 move the non-complementary plug 1 into the relief pocket 126. To further facilitate moving the non-complementary plug 1 into the relief pocket 126, an intersection surface 147 between the front surface 124 and the cavity 125 acts as a fulcrum to pivot the non-complementary plug 1 (FIGS. 15 and 16).

For means of comparison, a conventional electrical jack 11 is shown in FIGS. 6 and 8. The conventional electrical jack 11 has a cavity 12 accessible through an opening 13 in a front surface 14 of a housing 15. A stop member 16 is spaced inwardly of a cavity side wall 17 to limit insertion depth of an electrical plug. The inward spacing of the plug stop member 16 prevents distinguishing between complementary and non-complementary plugs, such that a non-complementary plug engages and can damage contact pins of the plug. The plug stop members 145 and 146 of the electrical jack 121 of the second exemplary embodiment only engage a complementary plug 5, such that a non-complementary plug 1 is not prevented from being guided to the relief pocket 126.

An electrical jack 221 in accordance with a third exemplary embodiment is shown in FIGS. 24-28. The electrical jack 221 of the third exemplary embodiment is substantially identical to the electrical jacks 21 and 121 of the first and second exemplary embodiments except for the configuration of the plug guides, or outer guide rails, 240 and 241. The same reference numerals are used to indicate similar features but in the 200 series, e.g., "2xx."

Figure 24:
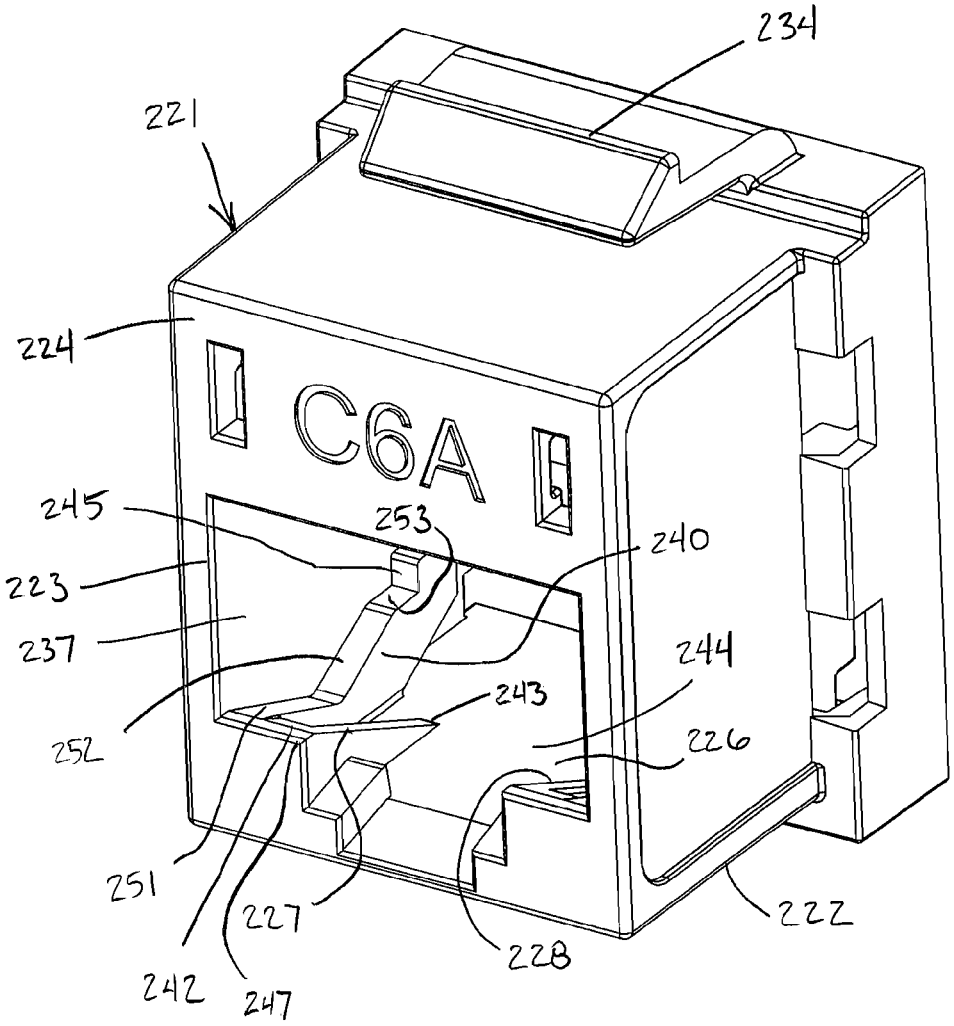
FIG. 24 is a perspective view of an electrical jack in accordance with a third exemplary embodiment of the present invention.
Figure 25:
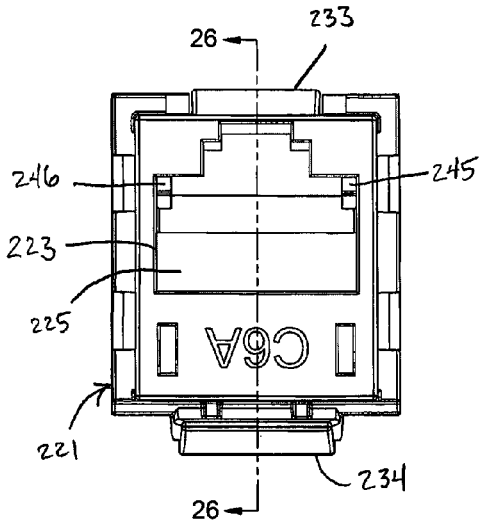
FIG. 25 is a front elevational view of the electrical jack of FIG. 24.
Figure 26:
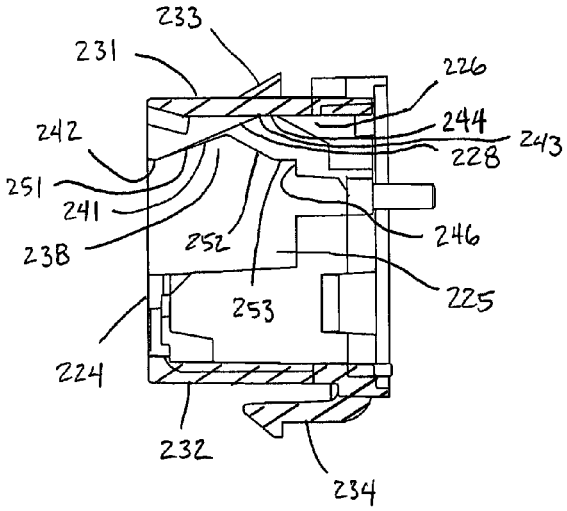
FIG. 26 is a side elevational view in cross-section of the electrical jack taken along line 26-26 of FIG. 25.

The guide rails, or inner guide rails, 227 and 228 are connected to and extend rearwardly along the inner side walls 237 and 238 of the cavity 225. As shown in FIGS. 24 and 26, plug guides, or outer guide rails, 240 and 241 are disposed between the guide rails 227 and 228 and their respective inner side walls 237 and 238. The guide rails 227 and 228 have first ends 242 spaced rearwardly of the front surface 224 and second ends 243 engaging an upper wall 244 of the cavity 225. The guide rails 227 and 228 are preferably substantially identical. As shown in FIG. 26, the guide rails 227 and 228 extend substantially continuously from the first end 242 to the second end 243 at a substantially constant angle and have a substantially flat surface. Plug stop members 245 and 246 are disposed at rearward ends of the plug guides 240 and 241 to limit the insertion depth of complementary plugs. The plug stop members 245 and 246 are adjacent the inner side walls 237 and 238.

The plug guides 240 and 241 have a first portion 251 extending rearwardly from the front surface 224 of the housing 222. The first portion 251 slopes toward the upper wall 244 of the cavity 225. The first portion 251 has a smaller angle relative to the horizontal than the angle of the guide rails 227 and 228, as shown in FIG. 24. A second portion 252 extends from an end of the first portion 251 rearwardly at an angle extending away from the upper wall 244 of the cavity 225. The second portion 252 extends in an opposite direction as the first portion 251 and the guide rails 227 and 228. A third portion 253 extends rearwardly from an end of the second portion 252 to the plug stop members 245 and 246. The third portion 253 is substantially parallel to the upper wall 244 of the cavity 225.

When a complementary plug, such as an RJ-45 plug 5, is inserted in a complementary jack 221, such as an RJ-45 jack, the width W2 of the plug 5 is substantially equal to a width between the side walls 237 and 238 of the cavity 225. Accordingly, an upper surface 9 of the complementary plug 5 engages the plug guides 240 and 241, which guide the complementary plug into the cavity 225. The front surface 10 of the complementary plug 5 is initially guided by the first portion 251 of the plug guides 240 and 241 until the upper surface 10 engages the second portions 252 of the plug guides 240 and 241. The complementary plug 5 continues to follow the second and third portions 252 and 253 of the plug guides 240 and 241 until the complementary plug engages the stop members 245 and 246, thereby limiting insertion of the complementary plug into the cavity. The transition of the second portion 252 to the third portion 253 of the plug guides 240 and 241 properly aligns the complementary plug in a functional position in the cavity 225. In the inserted position, the plug contacts 6 engage the contact pins 39 (FIG. 16) of the electrical jack, thereby establishing electrical continuity therebetween. The complementary plug 5 has an equivalent number of slots 7 as contact pins 39 in the cavity 225 of the electrical jack 221, such that the contact pins 39 are not damaged by insertion of the complementary plug.

When a non-complementary plug, such as an RJ-11 plug 1 (FIGS. 2 and 3), is inserted in a non-complementary jack 221, such as an RJ-45 jack, the width W1 of the non-complementary plug 1 is less than the width between the side walls 237 and 238 of the cavity 225. The width W1 of the non-complementary plug 1 is substantially equal to a width between the plug guides 240 and 241. Accordingly, an upper surface 18 of the non-complementary plug 1 engages the guide rails 227 and 228 disposed adjacent the plug guides 240 and 241 and is guided into the cavity 225. As the width of the non-complementary plug 1 is less than that between the side walls 237 and 238, the non-complementary plug does not engage the plug guides 240 and 241 and continues at the pre-determined angle to the relief pocket 226. The non-complementary plug 1 has fewer slots 3 than contact pins 39 (FIG. 16) in the electrical jack 221. Thus, a lower surface 19 of the non-complementary plug 1 is deflected upwardly by the contact pins 39 because there are no slots to receive the outermost contact pins 39. The guide rails 227 and 228 and the contact pins 39 move the non-complementary plug 1 into the relief pocket 226. To further facilitate moving the non-complementary plug 1 into the relief pocket 226, an intersection surface 247 between the front surface 224 and the cavity 225 acts as a fulcrum to pivot the non-complementary plug 1 (FIGS. 15 and 16).

For means of comparison, a conventional electrical jack 11 is shown in FIGS. 6 and 8. The conventional electrical jack 11 has a cavity 12 accessible through an opening 13 in a front surface 14 of a housing 15. A stop member 16 is spaced inwardly of a cavity side wall 17 to limit insertion depth of an electrical plug. The inward spacing of the plug stop member 16 prevents distinguishing between complementary and non-complementary plugs, such that a non-complementary plug engages and can damage contact pins of the plug. The plug stop members 245 and 246 of the electrical jack 221 of the third exemplary embodiment only engage a complementary plug 5, such that a non-complementary plug 1 is not prevented from being guided to the relief pocket 226.

Figure 29:
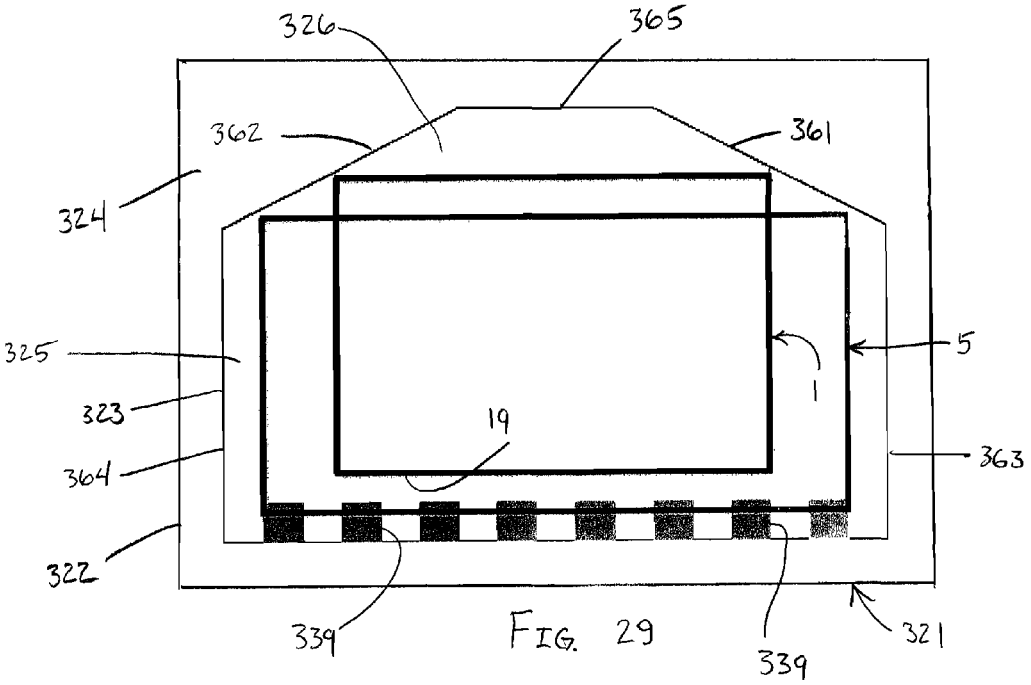
FIG. 29 is a schematic front elevational view of an electrical jack in accordance with a fourth exemplary embodiment of the present invention.

An electrical jack 321 in accordance with a fourth exemplary embodiment of the present invention is shown in FIG. 29. An opening 323 in a front surface 324 of a housing 322 of the electrical jack 321 has first and second angled portions 361 and 362 extending inwardly from upper ends of side walls 363 and 364 of the opening 323 toward an upper wall 365 of the opening 332. A relief pocket 326 is formed in an upper portion of the cavity 325.

When a complementary plug, such as an RJ-45 plug 5, is inserted in a complementary jack 321, such as an RJ-45 jack, the width W2 of the plug 5 is such that the first and second angled portions 361 and 362 guide the contacts of the plug 5 into engagement with the contact pins 339. The width W2 of the plug 5 prevents the plug from being deflected into the relief pocket 326 by the contact pins 339. The complementary plug 5 has an equivalent number of slots 7 as contact pins 339 in the cavity 325 of the electrical jack 321, such that the contact pins 339 are not damaged by insertion of the complementary plug.

When a non-complementary plug, such as an RJ-11 plug 1, is inserted in a non-complementary jack 321, such as an RJ-45 jack, the width W1 of the non-complementary plug 1 allows the contact pins 339 to deflect the non-complementary jack 321 to the relief pocket 326. The non-complementary plug 1 has fewer slots 3 than contact pins 339 in the electrical jack 321. Thus, a lower surface 19 of the non-complementary plug 1 is deflected upwardly by the contact pins 339 because there are no slots to receive the outermost contact pins 339. The contact pins 339 move the non-complementary plug 1 into the relief pocket 326, thereby substantially preventing damage to the contact pins 339.

Figure 30:
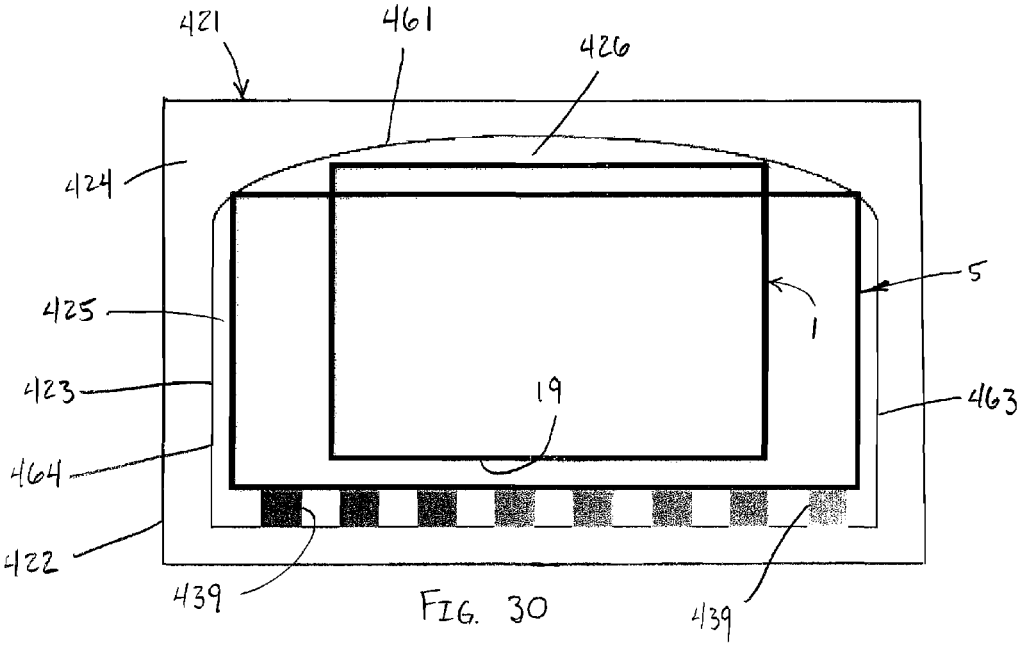
FIG. 30 is a schematic front elevational view of an electrical jack in accordance with a fifth exemplary embodiment of the present invention.

An electrical jack 421 in accordance with a fifth exemplary embodiment of the present invention is shown in FIG. 30. An opening 423 in a front surface 424 of a housing 422 of the electrical jack 421 has a curved portion 461 connecting upper ends of side walls 463 and 464 of the opening 423. A relief pocket 426 is formed in an upper portion of the cavity 425.

When a complementary plug, such as an RJ-45 plug 5, is inserted in a complementary jack 421, such as an RJ-45 jack, the width W2 of the plug 5 is such that the curved portion 461 guides the contacts of the plug 5 into engagement with the contact pins 439. The width W2 of the plug 5 prevents the plug from being deflected into the relief pocket 426 by the contact pins 439. The complementary plug 5 has an equivalent number of slots 7 as contact pins 439 in the cavity 425 of the electrical jack 421, such that the contact pins 439 are not damaged by insertion of the complementary plug.

When a non-complementary plug, such as an RJ-11 plug 1, is inserted in a non-complementary jack 421, such as an RJ-45 jack, the width W1 of the non-complementary plug 1 allows the contact pins 439 to deflect the non-complementary jack 421 to the relief pocket 426. The non-complementary plug 1 has fewer slots 3 than contact pins 439 in the electrical jack 421. Thus, a lower surface 19 of the non-complementary plug 1 is deflected upwardly by the contact pins 439 because there are no slots to receive the outermost contact pins 439. The contact pins 439 move the non-complementary plug 1 into the relief pocket 426, thereby substantially preventing damage to the contact pins 439.

The foregoing embodiments and advantages are merely exemplary and are not to be construed as limiting the scope of the present invention. The description of exemplary embodiments of the present invention are intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. An electrical jack, comprising:

a housing having an opening in a front face thereof;

a cavity in said housing for receiving a plug inserted in a longitudinal direction through said opening;

a plurality of contact pins disposed in said housing;

a relief pocket in said housing disposed rearwardly of said front face; and first and second guide rails disposed in said housing to guide a non-complementary plug inserted in said cavity obliquely away from said longitudinal direction and into said relief pocket to substantially prevent damage to said plurality of contact pins, each of said guide rails sloping away from said longitudinal direction from a first end thereof adjacent said opening to a second end thereof located in said relief pocket.

2. The electrical jack according to claim 1, wherein a complementary plug inserted in said cavity does not engage said first and second guide rails.

3. The electrical jack according to claim 2, wherein the complementary plug is an RJ-45 plug.

4. The electrical jack according to claim 1, wherein

—the non-complementary plug is an RJ-11 plug.

5. The electrical jack according to claim 1, wherein first and second plug guides guide a complementary plug inserted in said cavity along said longitudinal direction and into engagement with said plurality of contact pins.

6. The electrical jack according to claim 5, wherein said first and second guide rails are disposed between said first and second plug guides.

7. The electrical jack according to claim 1, wherein each of said first and second guide rails slopes continuously from its first end disposed rearwardly of said opening to its second end at an upper wall of said cavity.

8. The electrical jack according to claim 5, wherein said first and second plug guides are substantially parallel to an upper wall of said cavity.

9. The electrical jack according to claim 5, wherein each of said first and second plug guides has a portion extending rearwardly away from an upper wall of said cavity.

10. The electrical jack according to claim 5, wherein each of said first and second plug guides has a first portion extending rearwardly toward an upper wall of said cavity and a second portion extending rearwardly away from said upper wall of said cavity.

11. The electrical jack according to claim 5, wherein a plug stop member is disposed at a rearward end of each of said first and second plug guides to limit an insertion depth of the complementary plug.

12. The electrical jack according to claim 11, wherein the non-complementary plug does not engage said plug stop members when inserted in said cavity.

13. The electrical jack according to claim 1, wherein an intersection between said cavity and a front surface of said housing acts as a fulcrum to pivot the non-complementary plug upon insertion in said cavity to facilitate guiding the non-complementary plug to said relief pocket.

14. The electrical jack according to claim 1, wherein a first width of side walls of said cavity is substantially equal to a second width of a complementary plug.

15. The electrical jack according to claim 11, wherein a first width between said first and second plug guides is substantially equal to a second width of the non-complementary plug.

16. The electrical jack according to claim 11, wherein the plurality of contact pins deflect the non-complementary plug to the relief pocket.

17. An electrical jack, comprising:

a housing having an opening in a front face thereof;

a cavity in said housing for receiving a plug inserted in a longitudinal direction through said opening;

a plurality of contact pins disposed in said housing;

a relief pocket in said cavity disposed rearwardly of said opening and extending in the longitudinal direction substantially fully opposite said plurality of contact pins; and at least one sloped surface extending into the relief pocket, said opening and said at least one sloped surface being configured to guide a non-complementary plug inserted in said cavity obliquely away from said longitudinal direction and into said relief pocket to substantially prevent damage to said plurality of contact pins.

18. The electrical jack according to claim 17, wherein said upper wall of said cavity has first and second angled portions to prevent a complementary plug from entering said relief pocket.

19. The electrical jack according to claim 17, wherein an upper wall of said cavity is curved such that a complementary plug is prevented from entering said relief pocket.

20. The electrical jack according to claim 17, wherein the non-complementary plug is an RJ-11 plug.

* * * * *